US006781555B2

(12) United States Patent
Ramanujam et al.

(10) Patent No.: US 6,781,555 B2
(45) **Date of Patent: *Aug. 24, 2004**

(54) MULTI-BEAM ANTENNA COMMUNICATION SYSTEM AND METHOD

(75) Inventors: Parthasarathy Ramanujam, Redondo Beach, CA (US); Harold A. Rosen, Santa Monica, CA (US); Mark T. Austin, Mira Loma, CA (US); William D. Beightol, Riverside, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/093,117

(22) Filed: Mar. 5, 2002

(65) Prior Publication Data

US 2002/0101389 A1 Aug. 1, 2002

Related U.S. Application Data

(63) Continuation of application No. 09/703,605, filed on Oct. 31, 2000, now Pat. No. 6,388,634.

(51) Int. Cl.[7] ..... H01Q 13/00

(52) U.S. Cl. ..... 343/781 R; 343/781 P; 343/836; 343/DIG. 2

(58) Field of Search ..... 343/757, 772, 343/776, 781 R, 781 P, DIG. 2, 893, 916, 836; 5/837

(56) References Cited

U.S. PATENT DOCUMENTS

| | | | | |
|---|---|---|---|---|
| 3,541,553 A | | 11/1970 | Gubin | 343/100 |
| 3,720,953 A | | 3/1973 | Ajioka | 343/771 |
| 4,236,161 A | * | 11/1980 | Ohm | 343/781 CA |
| 4,343,005 A | | 8/1982 | Han et al. | 343/781 P |

(List continued on next page.)

FOREIGN PATENT DOCUMENTS

| | | | |
|---|---|---|---|
| EP | 0 549 220 | A2 | 6/1993 |
| EP | 0 776 099 | A2 | 5/1997 |
| EP | 0 860 952 | A2 | 8/1998 |
| EP | 0 961 416 | A1 | 12/1999 |
| EP | 1 122 813 | A2 | 8/2001 |
| EP | 1 161 001 | A2 | 12/2001 |
| GB | 2 349 045 | A | 10/2000 |
| JP | 2001345747 | A | 12/2001 |
| WO | WO 97/07609 | A | 2/1997 |
| WO | WO 01/95520 | A2 | 12/2001 |
| WO | WO 01/95523 | A3 | 12/2001 |
| WO | WO 01/97388 | A3 | 12/2001 |
| WO | WO 01/97406 | A3 | 12/2001 |

OTHER PUBLICATIONS

U.S. patent application Ser. No. 09/661,986, Rosen et al., filed Sep. 14, 2000.

K. K. Chan, F. Marcoux, M. Forest, L. Martins–Camelo, "A Circularly Polarized Waveguide Array for Leo Satellite Communications", pp. 154–157, 1999 IEEE AP–S International Symposium, Jun. 1999.

(List continued on next page.)

*Primary Examiner*—Shih-Chao Chen
(74) *Attorney, Agent, or Firm*—Georgann S. Grunebach; John A. Crook, III

(57) ABSTRACT

A communication system and method for reconfigurably transmitting and receiving signals via a multi-beam reflector antenna array are disclosed. The multi-beam antenna system comprises a plurality of rings of single beam reflectors, each reflector having its own feed, wherein the plurality of rings are substantially concentric or nested and disposed on separate planes such that the reflectors of adjacent rings are substantially interleaved. The method, in one embodiment, comprises generating beams from a first, second and third ring of single beam feeds, respectively reflecting each beam from the first, second and third ring of single beam feeds on a separate reflector to a substantially separate coverage area, wherein the first, second and third rings are substantially concentric and disposed on separate planes such that the reflectors of adjacent rings are substantially interleaved.

59 Claims, 7 Drawing Sheets

U.S. PATENT DOCUMENTS

| | | | | | |
|---|---|---|---|---|---|
| 4,635,063 | A | | 1/1987 | Chang et al. | |
| 4,799,065 | A | | 1/1989 | Thompson | 343/779 |
| 4,819,227 | A | | 4/1989 | Rosen | 370/75 |
| 4,823,341 | A | | 4/1989 | Rosen | |
| 5,017,927 | A | | 5/1991 | Agrawal et al. | 342/371 |
| 5,081,464 | A | | 1/1992 | Renshaw | |
| 5,151,706 | A | | 9/1992 | Roederer et al. | 342/372 |
| 5,257,030 | A | | 10/1993 | Aoki et al. | 342/368 |
| 5,339,330 | A | * | 8/1994 | Mallinckrodt | 370/320 |
| 5,365,239 | A | | 11/1994 | Stilwell, Jr. | 342/368 |
| 5,552,798 | A | | 9/1996 | Dietrich et al. | 343/893 |
| 5,584,047 | A | | 12/1996 | Tuck | 455/13.1 |
| 5,594,941 | A | | 1/1997 | Dent | 455/13.4 |
| 5,652,597 | A | * | 7/1997 | Caille | 343/756 |
| 5,754,139 | A | | 5/1998 | Turcotte et al. | 342/373 |
| 5,764,187 | A | | 6/1998 | Rudish et al. | 342/372 |
| 5,790,070 | A | | 8/1998 | Natarajan et al. | 342/354 |
| 5,818,395 | A | * | 10/1998 | Wolcott et al. | 343/753 |
| 5,856,804 | A | | 1/1999 | Turcotte et al. | 342/371 |
| 5,903,549 | A | | 5/1999 | Von der Embse et al. | |
| 5,907,816 | A | | 5/1999 | Newman et al. | |
| 5,909,460 | A | | 6/1999 | Dent | 375/200 |
| 5,917,447 | A | | 6/1999 | Wang et al. | |
| 5,946,625 | A | | 8/1999 | Hassan et al. | |
| 5,963,175 | A | * | 10/1999 | Burr | 343/781 P |
| 5,966,371 | A | | 10/1999 | Sherman | |
| 5,973,647 | A | | 10/1999 | Barrett et al. | 343/713 |
| 5,974,317 | A | | 10/1999 | Djuknic et al. | 455/431 |
| 5,974,324 | A | | 10/1999 | Henson | 455/447 |
| 5,982,337 | A | | 11/1999 | Newman et al. | 343/816 |
| 5,990,839 | A | | 11/1999 | Schefte et al. | 343/702 |
| 6,002,935 | A | | 12/1999 | Wang | 455/447 |
| 6,014,372 | A | | 1/2000 | Kent et al. | 370/316 |
| 6,016,124 | A | | 1/2000 | Lo et al. | 342/373 |
| 6,018,316 | A | | 1/2000 | Rudish et al. | 342/361 |
| 6,034,634 | A | | 3/2000 | Karlsson et al. | 342/359 |
| 6,061,562 | A | | 5/2000 | Martin et al. | 455/431 |
| 6,088,341 | A | | 7/2000 | Hinedi et al. | |
| 6,111,542 | A | | 8/2000 | Day et al. | 342/359 |
| 6,147,658 | A | | 11/2000 | Higashi et al. | 343/853 |
| 6,150,977 | A | | 11/2000 | Wilcoxson et al. | 342/355 |
| 6,151,308 | A | | 11/2000 | Ibanez-Meier et al. | |
| 6,157,621 | A | | 12/2000 | Brown et al. | 370/310 |
| 6,169,910 | B1 | | 1/2001 | Tamil et al. | 455/562 |
| 6,173,178 | B1 | | 1/2001 | Hammill et al. | 455/429 |
| 6,188,896 | B1 | | 2/2001 | Perahia et al. | |
| 6,195,037 | B1 | | 2/2001 | Gross et al. | 342/354 |
| 6,204,822 | B1 | | 3/2001 | Cardiasmenos et al. | |
| 6,204,823 | B1 | | 3/2001 | Spano et al. | 343/766 |
| 6,208,858 | B1 | | 3/2001 | Antonio et al. | 455/429 |
| 6,240,072 | B1 | | 5/2001 | Lo et al. | 370/316 |
| 6,259,415 | B1 | | 7/2001 | Kumpfbeck et al. | 343/765 |
| 6,266,528 | B1 | | 7/2001 | Farzaneh | 455/423 |
| 6,289,004 | B1 | | 9/2001 | Mesecher et al. | |
| 6,317,412 | B1 | | 11/2001 | Natali et al. | |
| 6,339,708 | B1 | | 1/2002 | Wang | 455/447 |
| 6,366,256 | B1 | * | 4/2002 | Ramanujam et al. | 343/781 CA |
| 6,377,802 | B1 | | 4/2002 | McKenna et al. | 455/430 |
| 6,380,893 | B1 | | 4/2002 | Chang et al. | |
| 6,388,615 | B1 | | 5/2002 | Chang et al. | 342/368 |
| 6,392,611 | B1 | * | 5/2002 | Smith et al. | 343/912 |
| 6,414,646 | B2 | | 7/2002 | Luh | 343/781 CA |
| 6,429,823 | B1 | | 8/2002 | Bains et al. | 343/755 |
| 6,434,384 | B1 | | 8/2002 | Norin et al. | 455/429 |
| 6,452,962 | B1 | | 9/2002 | Linsky et al. | |
| 6,456,846 | B2 | | 9/2002 | Norin et al. | 455/429 |
| 6,463,282 | B2 | * | 10/2002 | Norin et al. | 455/429 |
| 6,463,294 | B1 | | 10/2002 | Holma et al. | |
| 6,507,314 | B2 | | 1/2003 | Chang et al. | 342/373 |
| 6,556,845 | B1 | | 4/2003 | Ide et al. | 455/562 |
| 6,559,797 | B1 | | 5/2003 | Chang | 342/368 |
| 6,567,052 | B1 | | 5/2003 | Wang et al. | 343/765 |
| 2001/0048389 | A1 | | 12/2001 | Nakagawa | 342/378 |
| 2002/0006795 | A1 | | 1/2002 | Norin | 455/429 |
| 2002/0050946 | A1 | | 5/2002 | Chang et al. | 342/368 |
| 2002/0126042 | A1 | | 9/2002 | Chang et al. | 342/354 |
| 2002/0140602 | A1 | | 10/2002 | Chang et al. | 342/368 |
| 2003/0076258 | A1 | | 4/2003 | Chang et al. | 342/373 |

OTHER PUBLICATIONS

M. Oodo, R. Miura, Y. Hase, "Onboard DBF Antenna for Stratospheric Platform", pp. 125–128, IEEE Conference on Phased Array Systems and Technology, California, May 21–25, 2000.

Yokosuka Research Park, "The First Stratospheric Platform Systems Workshop", pp 1–216, May 12–13, 1999.

Suzuki, R. et. al, :Mobile TDM/TDMA System With Active Array Antenna, Global Telecommunications Conference, 1991; Globecom '91, vol. 3, Dec. 2–5, 1991, pp. 1569–1573.

Miura, Ryu et. al, "A DBF Self–Beam Steering Array Antenna for Mobile Satellite Applications Using Beam–Space Maximal–Ratio Combination", IEEE Trans. On Vehicular Technology, vol. 48, No. 3, May 1999, pp. 665–675.

Sato, Kazuo et al., "Development And Field Experiments of Phased Array Antenna For Land Vehicle Satellite Communications", IEEE Antennas and Propagation Society International Symposium, 1992, Jul. 1992, pp. 1073–1076.

Sakakibara, Kunio et. al, "A Two–Beam Slotted Leaky Waveguide Array for Mobile Reception of Dual–Polarization DBS", IEEE Transactions on Vehicular Technology, vol. 48, No. 1, Jan. 1999, pp. 1–7.

* cited by examiner

MULTI-BEAM ANTENNA COMMUNICATION SYSTEM AND METHOD

CROSS-REFERENCE TO RELATED APPLICATION

This is a continuation of Ser. No. 09/703,605, filed on Oct. 31, 2000 now U.S. Pat. No. 6,388,634, entitled "Multi-Beam Antenna Communication System and Method", inventors Parthasarathy Ramanujam, Harold A. Rosen, Mark T. Austin and William D. Beightol, now pending, the entire contents of which are incorporated herein by this reference.

BACKGROUND OF THE INVENTION

1. Field of the Invention

The present invention relates to systems and methods for transmitting communication signals, and in particular to systems and methods for transmitting communication signals across high scan angles.

2. Description of the Related Art

Communications satellites are in widespread use and communication systems based upon high-altitude platforms are under development. Such wireless communications systems are used to deliver television and other communications signals to end users.

The primary design constraints for communications satellites and platforms are antenna beam coverage and radiated Radio Frequency (RF) power. These two design constraints are generally paramount in the payload design because they determine which locations on the ground will be able to receive communications service. In addition, the system weight becomes a factor, because launch vehicles and platforms are limited as to how much payload weight can be placed on station.

Further, in high-altitude platform and Low Earth Orbit (LEO) satellite applications it is often necessary to form multiple antenna beams illuminating the ground. Such communication systems require antennas with on-station beam coverage systems capable of altering the beam scan on the ground as well as the beam shape.

Since it is desirable for ground coverage to be evenly distributed among a wide pattern of cells, producing an even pattern on the ground requires a versatile antenna system capable of high scan angles. This presents a difficult problem to antenna system designers.

Three alternative antenna configurations that are generally known in the art are a multi-feed reflector, a single beam phased array and a multibeam phased array. However, each of these configurations has limitations in high-altitude platform and LEO applications.

One configuration known in the art uses a single parabolic reflector with multiple feeds. In order to generate different beam shapes, multiple feeds are combined using a complex beam forming network. Hence a very large number of feeds and multiple Beam Forming Networks (BFNs) are required. In addition, a very large number of parabolic reflectors, requiring an enormous physical envelope, would be needed to apply this configuration in near Earth applications. Due to the wide angular coverage required, each reflector could be used to produce a spot beam over only a very small portion of the overall coverage area.

Another configuration is described by K. K. Chan, et al., *A Circularly Polarized Waveguide Array for LEO Satellite Communications*, IEEE AP-S International Symposium, June 1999 which is hereby incorporated by reference herein. The proposed system requires a single beam phased array for each beam. While this approach can be used to form different beam shapes, such a system is costly to produce. Furthermore, due to the inherent nature of a phased array, wide-band operation, necessary for simultaneous transmit-receive applications, can be almost impossible to achieve.

A third configuration known in the art uses a multiple-beam phased array. Antenna configurations using multiple-beam phased arrays are inherently more complex and expensive than other configurations. Furthermore, the wide-angle scanning requirement of near Earth applications necessitates the use of very small elements resulting in a large number of elements in the array, thereby increasing the cost and complexity. Alternatively, a plurality of separate phased arrays may be employed, each one operating over a narrow region, however the complexity and expense would be undiminished.

There is therefore a need in the art for a compact, less costly, antenna system capable of simultaneous transmit-receive applications, without the attendant complexity and/or size of prior art systems.

SUMMARY OF THE INVENTION

To address the requirements described above, and to overcome other limitations that will become apparent upon reading and understanding the present specification, the present invention discloses an apparatus and method for transmitting and receiving signals with a multi-beam reflector antenna assembly.

The present invention teaches a multi-beam antenna assembly, comprising a plurality of rings of single beam shaped reflectors, each reflector having its own feed, wherein the plurality of rings are substantially nested or concentric and disposed on separate planes such that the reflectors of adjacent rings are substantially interleaved as viewed from above. In one embodiment, each feed is diplexed to provide both transmit and receive functionality. In one embodiment, the rings are substantially circular in a concentric configuration. Alternate configurations may employ rings of other shapes in a nested configuration.

The present invention also teaches a method of producing multiple antenna beams, comprising generating a plurality of beams from a plurality of single beam feeds, respectively reflecting each beam from a separate reflector of a plurality of single beam reflector rings to a substantially separate coverage area, wherein the reflector rings are substantially nested/concentric and disposed on separate planes such that the reflectors of adjacent rings are substantially interleaved as viewed from above.

The present invention also teaches a communication system having at least one above-ground platform having a multi-beam antenna including a plurality of rings, each ring having a plurality of single beam shaped reflectors, each reflector having its own feed, wherein the rings are substantially nested or concentric and disposed on separate planes such that the shaped reflectors of adjacent rings are substantially interleaved as viewed from above.

The present invention produces a uniform coverage pattern of cells defined as hexagons on the ground from a near Earth station, orbital or otherwise.

The present invention provides an antenna configuration used to generate multiple beams, with the capability of optimizing each of the beams independently for mainlobe and sidelobe performance.

Each cell is covered by a separate feed and reflector combination. Each feed and reflector can also be optimized to provide uniform cell illumination for both transmit and receive functions.

The present invention can be used to optimize wide-band performance in a simple and effective manner. Further, the number of rings can be extended to generate more beams and thus a greater number of ground cells.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1A:
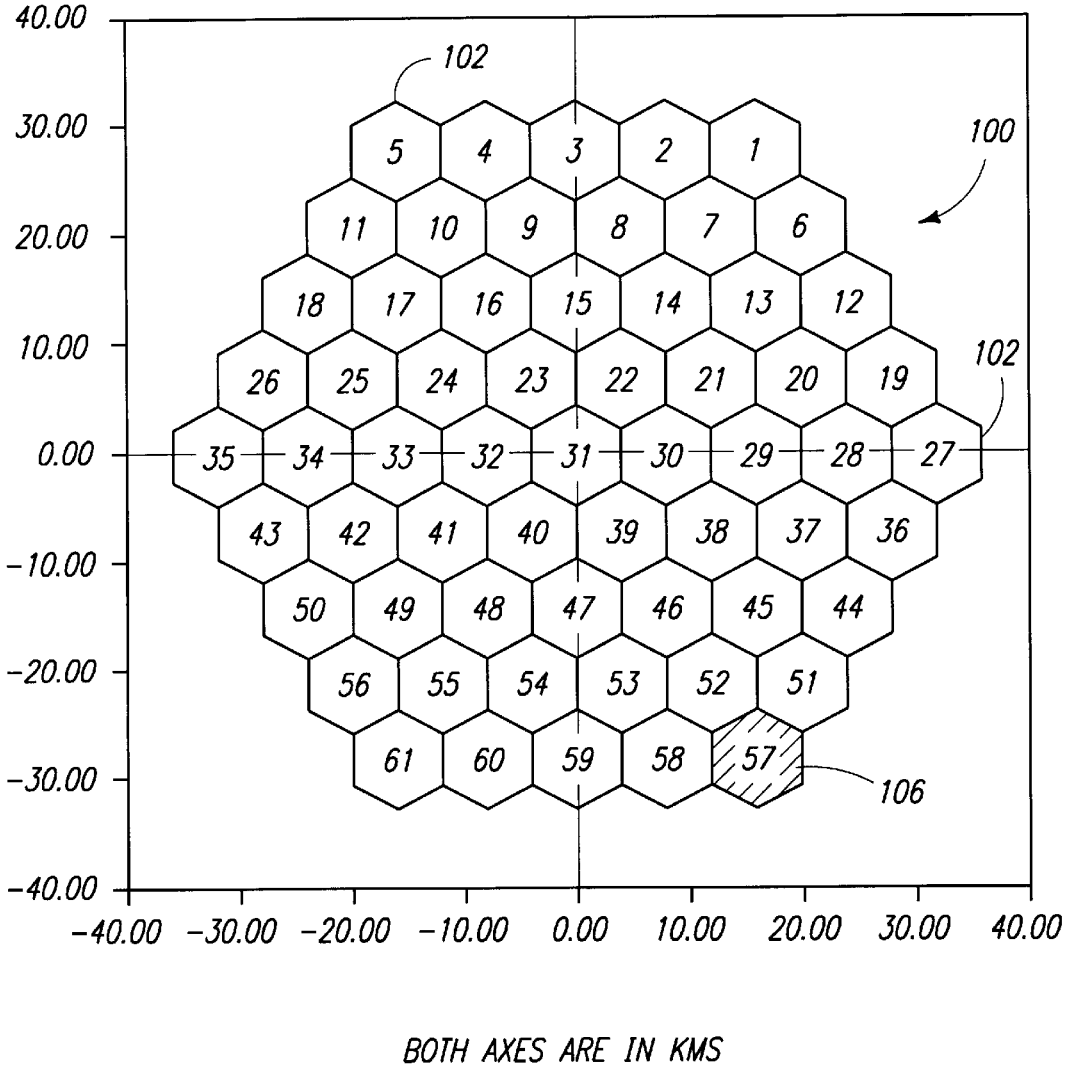
FIGS. 1A–1B illustrate a ground pattern of identical fixed cells with a cell separation of 8 Kms and the corresponding beam pattern as seen from a platform altitude of 20 kilometers.
Figure 1B:
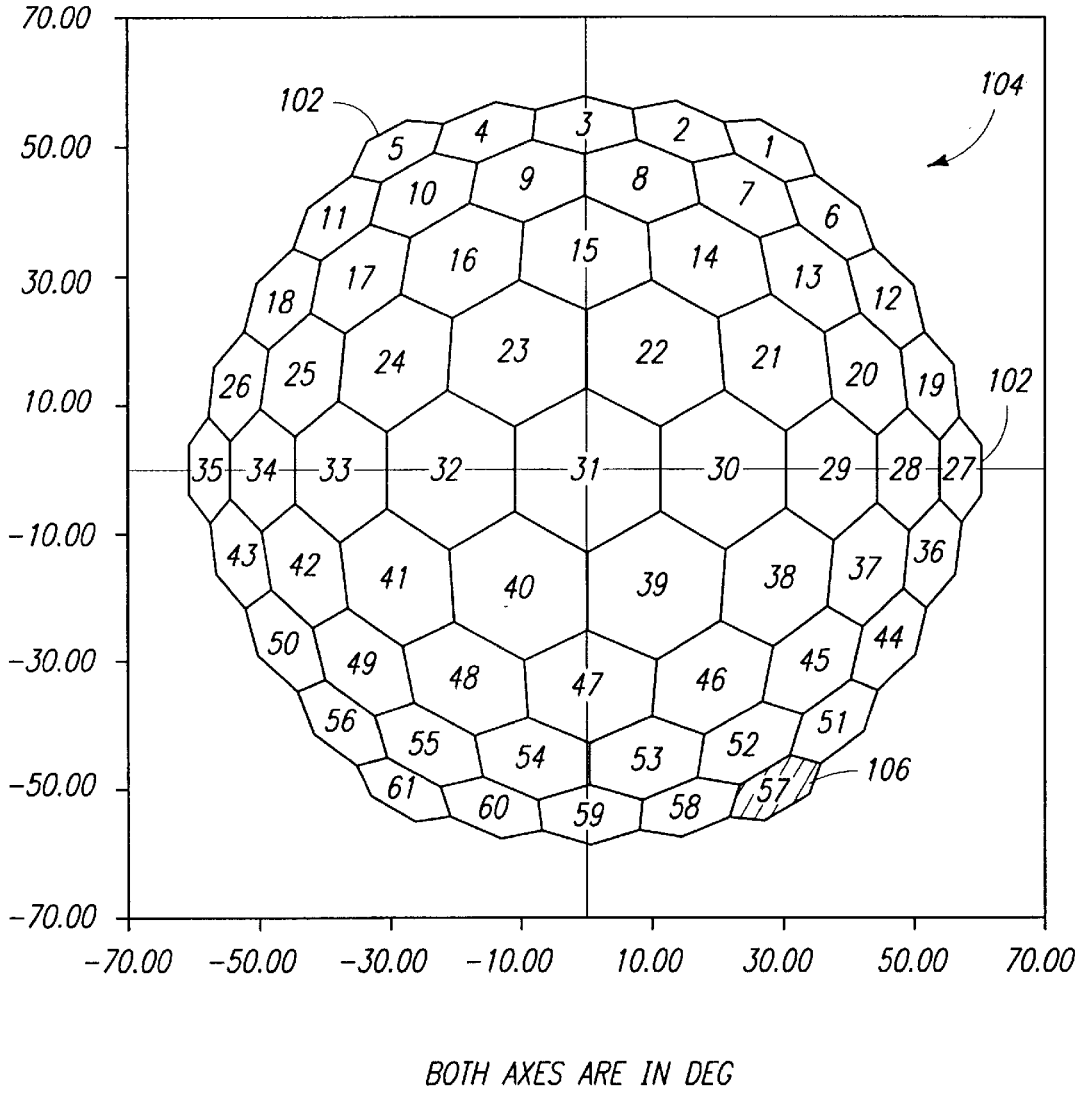

FIG. 1A illustrates a ground pattern 100 in km of sixty-one identical fixed cells 102 with a cell separation of 8 km. The uniform cells 102 are defined as hexagons on the ground. FIG. 1B illustrates the corresponding cells 102 in degrees generated from an altitude of 20 km, in the on-station pattern 104. Due to the inherent geometry, the required antenna scan angle can be very large, requiring an angular sweep greater than ±50° for antennas at or near the nadir. Further, the on-station pattern 104 is distorted when compared to the ground pattern 100 of cells 102. Such an on-station pattern 104 can be generated by an antenna configuration of the invention.

The exact number of cells 102 used in the ground pattern 100, as well as the shape of the overall ground pattern 100 can be varied depending upon the specific application. In particular, coverage of one or more of the cells 102 may be omitted if the region is located in an unpopulated or inaccessible area. Likewise, additional cells 102 may be included to cover appended geography. The overall ground pattern 100 may have the shape of any geography within the scan range of the on-station pattern 104. In addition, individual cells 102 may have different shapes; uniform ground cell shapes are not required.

Figure 2C:
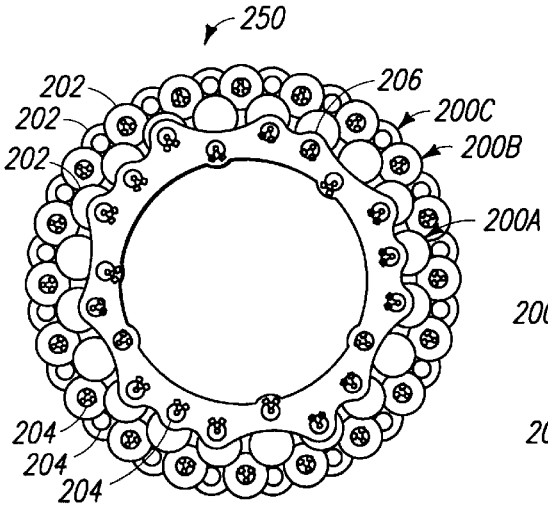
FIGS. 2A–2C illustrate a reflector antenna embodiment producing a coverage pattern from 20 km.
Figure 2A:
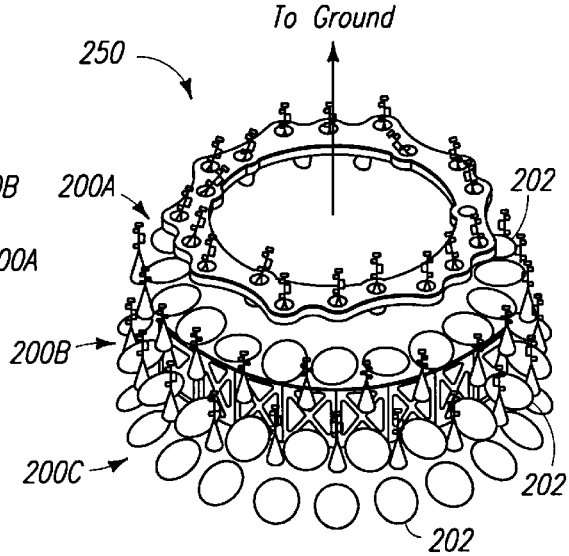
Figure 2B:
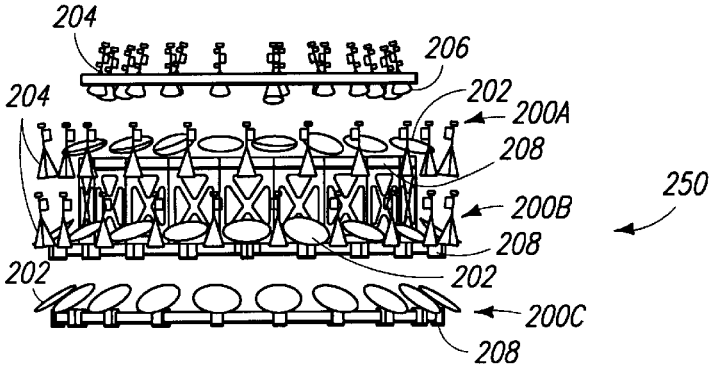

FIGS. 2A–2C depicts one embodiment of a multi-beam satellite system 250 comprising three sets of twenty reflectors 202 arranged in substantially concentric circular reflector rings 200A–200C (hereinafter alternatively collectively referred to as reflector ring(s) 200) to cover any 60 of the 61 cells in the ground pattern 100. Each reflector 202 is used to produce coverage of one cell 102 in the overall coverage pattern 100, 104. Each reflector 202 has its own feed 204. As shown in FIG. 2C, the first, second and third reflector rings 200 are substantially concentric and disposed on separate planes such that the reflectors 202 of adjacent rings 200 are substantially interleaved as viewed from above. This configuration allows for a compact arrangement of a large number of reflectors 202 having optimized fields of view.

In the embodiment of FIGS. 2A–2C, the reflector rings 200 are substantially circular. Alternate configurations may employ rings 200 of other shapes which are nested and disposed on separate planes and similarly present reflectors 202 of adjacent rings 200 substantially interleaved as viewed from above.

Also in the embodiment of FIGS. 2A–2C, inner reflector rings 200A of smaller diametric extent (e.g. diameter, for circular reflector rings) are disposed at higher planes, nearer to ground. Alternate configurations may arrange the rings 200 such that the outer reflector rings 200 are disposed at higher planes or employ a mixture of higher and lower planes of rings 200 as necessary to achieve optimal coverage for a given application.

As previously discussed, one cell 106 in the example coverage pattern 100, 104 of FIGS. 1A and 1B is not covered and therefore does not receive a beam from one of the reflectors 202. The antenna of FIGS. 2A–2C covers sixty of the sixty-one cells of FIG. 1A. Coverage of any cell 102 may be omitted depending upon the particular geography and application of the antenna. In addition, cells may also overlap to achieve better performance or expanded service.

The correspondence between cells 102 and reflectors 202 is determined in part according to field of view considerations. Although the invention produces a versatile antenna whereby most reflectors 202 have potential fields of view including many, if not all, cells 102 in the coverage pattern 100, 104, some reflectors 202 may not have a potential field of view including some cells 102 due to obstruction by the structure. For example, in the embodiment of FIGS. 2A–2C, a reflector 202 of the outermost ring 200 may not have a view of a cell 102 located on the opposite side of the coverage pattern 100, 104, depending upon the platform 252 or satellite orientation and the required scan angle. However, an optimal field of view design using the invention for a specified application is easily developed with the reflector rings 200 arranged at different planes. In the embodiment of FIGS. 2A–2C, reflectors 202 of the outer reflector rings 200 generally cover outer cells 102 of the coverage pattern 100, 104 nearest to the particular reflector 202.

In addition, the present invention can optionally incorporate an efficient structure as shown in FIGS. 2A–2C. The feed horns 204 for the third reflector rings 200C are affixed to support structure 208 of the second reflector ring 200B between the reflectors 202. The feed horns 204 for the first reflector ring 200A are attached to a feed horn ring structure 206 disposed from the first reflector ring 200. This particular structure of the feed horns 204 is not essential for operation of the present invention, however.

Figure 2D:
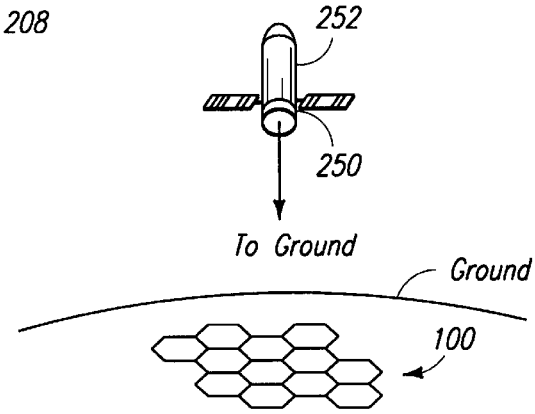
FIG. 2D is a diagram illustrating the payload deployed on an above-ground platform.

FIG. 2D is a diagram showing the implementation of the multibeam antenna system 250 on an above-ground or high altitude platform 252.

Figure 3:
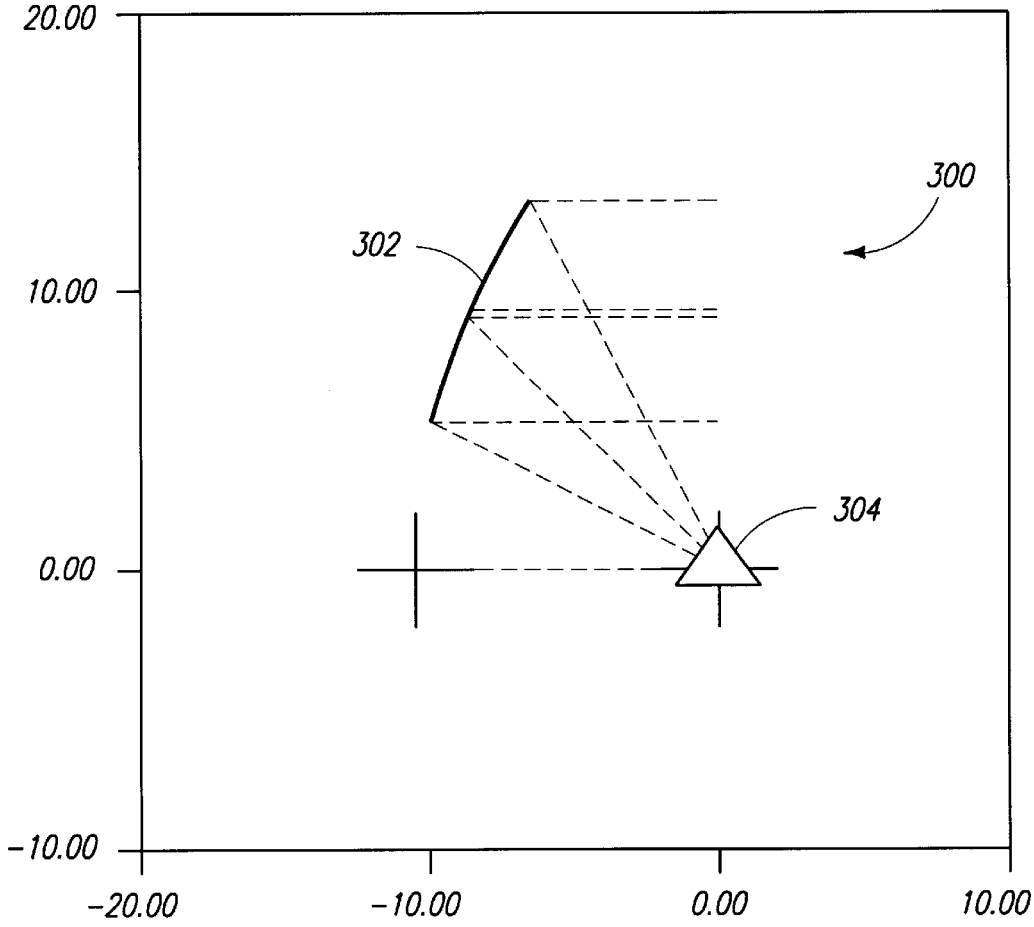
FIG. 3 is a schematic diagram of a single offset reflector geometry with a reflector diameter of 8 inches.

FIG. 3 is a schematic diagram of a single offset reflector geometry 300 used in one embodiment of the present invention. All the sixty beams of the example embodiment are individually produced by reflectors 302 of a substantially identical diameter of 8 inches. Each reflector 302 is separately fed by a high performance feed horn 304 operating at two or more operating frequencies or frequency bands, 20 and 30 GHz for example. One or more of the feeds may be corrugated horns.

Alternatively, individual reflectors 302 may be individually shaped and/or sized (e.g. of different diametric extent)

to optimize the performance at the two frequency bands, taking into account the sidelobe suppression required in some of the cells 102. The use of shaped reflectors 302 allows for a much more efficient and compact antenna configuration. Also, although uniformity of the reflectors 302 is desirable to facilitate manufacturing, individual reflectors 302 may be customized for custom applications or services.

Figure 4A:
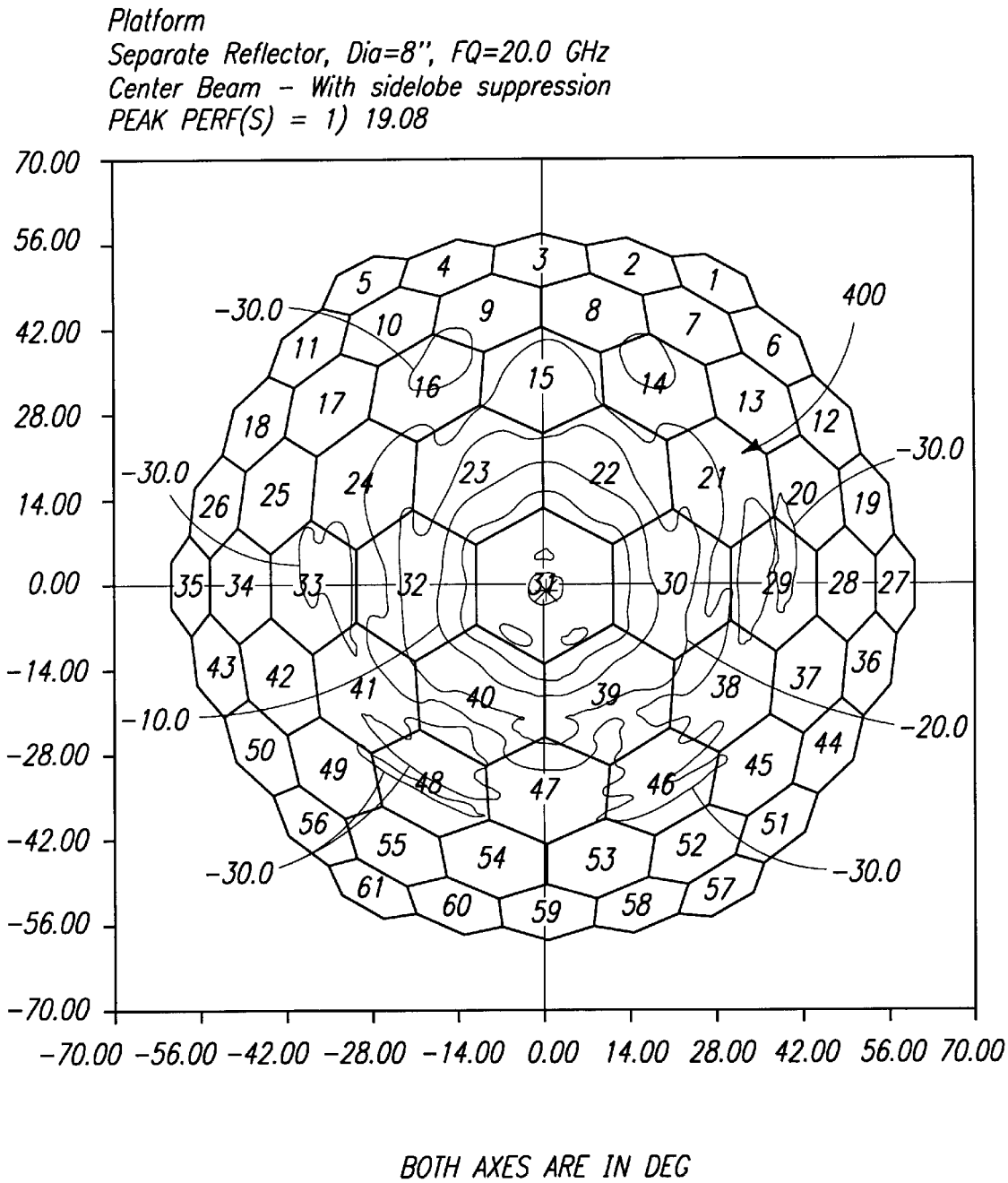
FIGS. 4A–4C depict examples of central, middle and outer reflector ring beams with suppressed sidelobes.
Figure 4B:
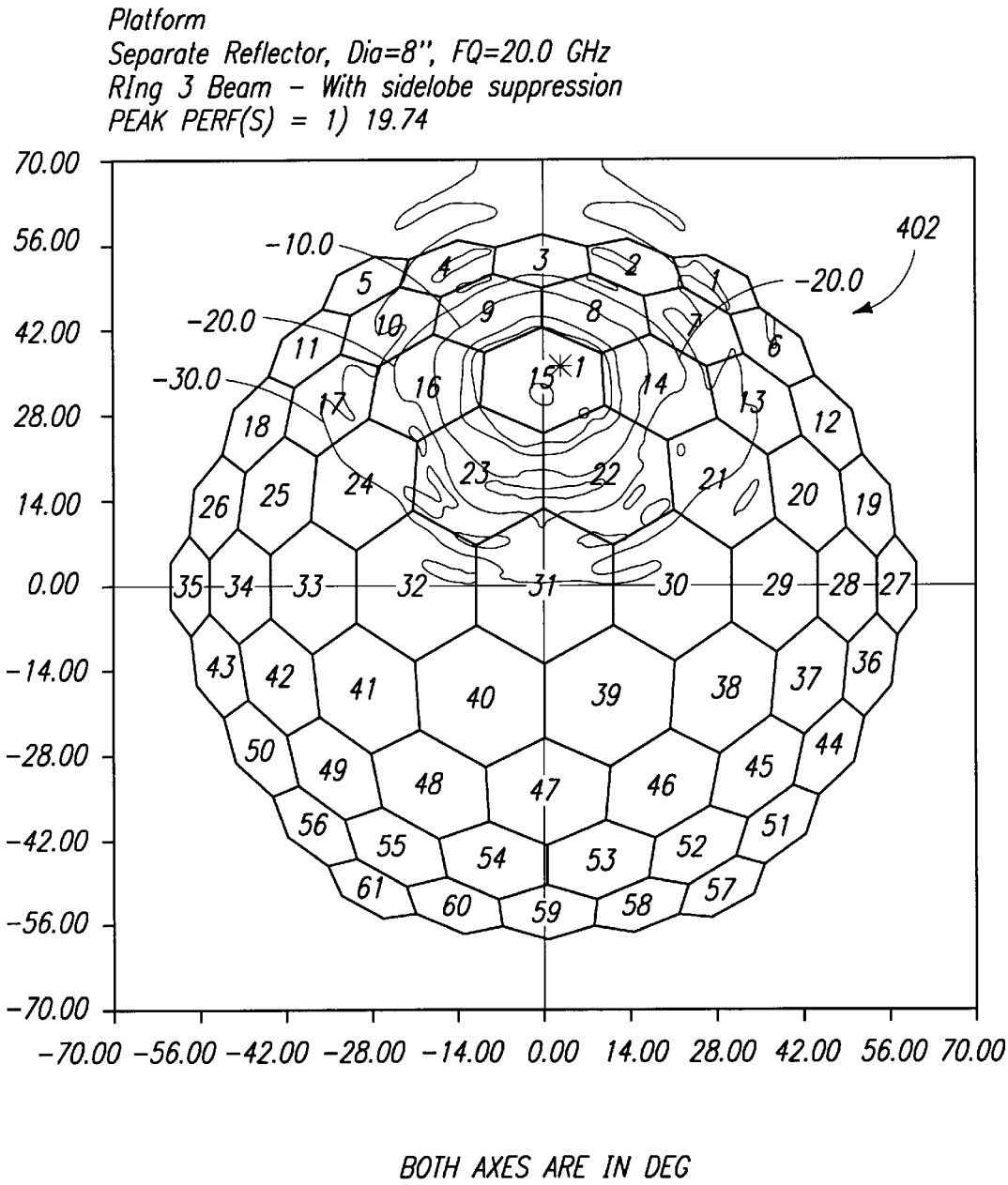
Figure 4C:
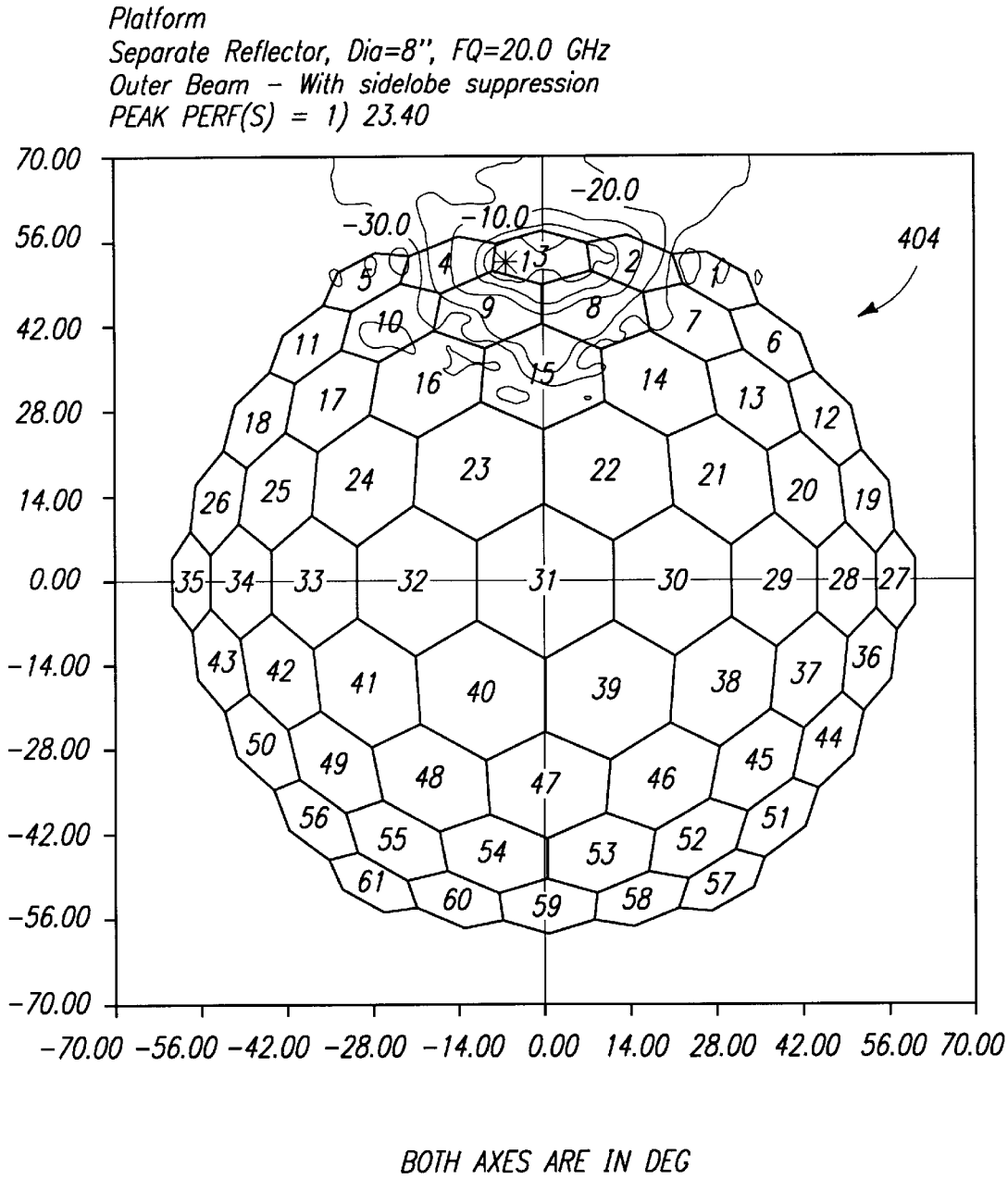

FIGS. 4A–4C illustrate radiation patterns 400, 402, and 404 at 20 GHz for three example cells 102 respectively from the central, middle and outer rings. In order to use the similar reflector geometry for all the beams 102, each reflector 302 position is appropriately rotated to point at its respective beam center. The inherent characteristic of this approach allows all of the reflectors 302 to be arranged in a few rings 200. One embodiment of the invention is an antenna configuration which generates each of the beams from an individual reflector 302, with each beam independently optimized for mainlobe and sidelobe performance.

The antenna configuration can be used in any high frequency application, and particularly the Ku, Ka and higher bands, generating clusters of beams over a wide angular range. However, the invention can also be applied to lower frequency bands when larger antenna assembly can be accommodated.

Although each of the reflectors 302 presented in the foregoing example are nominally eight inches in diameter, the size (i.e. diametric extent in any direction) and/or shape of the reflectors 302 can be altered to optimize the design to account for different operating frequencies, platform altitudes, and the size/shape of the cells in the ground pattern 100 or the on-station pattern 104, and/or platform to cell geometry. Similarly, the feeds 304 for each reflector can also be optimized with respect to the same parameters. For example, cells in the on-station pattern 104 located below the platform near the center of the on-station pattern 104 are typically larger than those at the periphery. To account for this difference, the reflectors used to service such cells can be smaller than those used to service the peripheral cells.

Many modifications may be made to this invention without departing from the scope of the present invention. For example, any combination of the above components, or any number of different components, and other devices, may be used with the present invention.

Conclusion

This concludes the description of the preferred embodiments of the present invention. In summary, the present invention teaches a multi-beam antenna system, comprising, in an exemplary embodiment, a first, second and third ring of single beam reflectors, each reflector having its own feed, wherein the first, second and third rings are substantially concentric and disposed on separate planes such that the reflectors of adjacent rings are substantially interleaved as viewed from above.

The present invention also teaches a method of producing multiple antenna beams, comprising, in an exemplary embodiment, generating beams from a first, second and third ring of single beam feeds, respectively reflecting each beam from the first, second and third ring of single beam feeds on a separate reflector to a substantially separate coverage area, wherein the first, second and third rings are substantially concentric and disposed on separate planes such that the reflectors of adjacent rings are substantially interleaved as viewed from above.

The present invention also teaches a communication system comprising at least one platform having a multi-beam antenna including a plurality of rings, each ring having a plurality of single beam shaped reflectors, each reflector having its own feed; wherein the rings are substantially concentric and disposed on separate planes such that the shaped reflectors of adjacent rings are substantially interleaved as viewed from above.

The foregoing description of the preferred embodiment of the invention has been presented for the purposes of illustration and description. It is not intended to be exhaustive or to limit the invention to the precise form disclosed. Many modifications and variations are possible in light of the above teaching. It should be understood, of course, that the foregoing disclosure relates only to preferred embodiments of the invention and that numerous modifications or alterations may be made therein without departing from the spirit and the scope of the invention as set forth in the appended claims.

What is claimed is:

1. A multi-beam antenna system for generating multiple beams, comprising a plurality of single beam reflectors, each having its own feed, the plurality of single beam reflectors producing a plurality of beams, each beam serving a substantially separate cell of an on-station pattern; and wherein at least one of the plurality of beams is optimized for an operational characteristic.

2. The multi-beam antenna of claim 1, wherein the operational characteristic includes mainlobe performance.

3. The multi-beam antenna of claim 1, wherein the operational characteristic includes sidelobe performance.

4. The multibeam antenna of claim 3, wherein the sidelobe performance includes sidelobe suppression over an associated cell of each reflector.

5. The multi-beam antenna of claim 1, wherein the operational characteristic includes a size of the cell served by the beam.

6. The multi-beam antenna of claim 1, wherein the operational characteristic includes a shape of the cell served by the beam.

7. The multi-beam antenna of claim 1, wherein the plurality of reflectors are disposed on a platform and the operational characteristic includes platform to cell geometry.

8. The multi-beam antenna system of claim 1, wherein the operational characteristic includes an altitude of the single beam reflectors.

9. The multi-beam antenna system of claim 1, wherein the operational characteristic includes an operating frequency.

10. The multi-beam antenna system of claim 1, wherein the operational characteristic includes a beam field of view.

11. The multi-beam antenna system of claim 1, wherein the operational characteristic includes uniform illumination of the cell.

12. The multi-beam antenna system of claim 1, wherein a reflector associated with the at least one of the plurality of beams is shaped to provide the optimized operational characteristic.

13. The multi-beam antenna system of claim 1, wherein a feed associated with the at least one of the plurality of beams is optimized to provide the optimized operational characteristic.

14. The multi-beam antenna system of claim 1, wherein each reflector is pointed at a center of the beam produced by the reflector.

15. The multi-beam antenna system of claim 1, wherein each reflector is rotated to point at a center of the beam produced by the reflector.

16. The multi-beam antenna of claim 1, wherein a shape of at least one of the cells of the on-station pattern is different than a shape of another one of the cells of the on-station pattern.

17. The multi-beam antenna of claim 1, wherein coverage of one or more cells of the on-station pattern is omitted.

18. The multi-beam antenna of claim 1, wherein one or more cells of the on-station pattern overlap.

19. A method of producing multiple antenna beams, comprising:

generating a plurality of beams from a plurality of single beam feeds; and reflecting each beam from a separate reflector of a plurality of single beam reflector rings to a substantially separate coverage area;

wherein at least one of the single beam reflectors or respective feeds servicing the cells includes design parameters that are optimized for an operational characteristic.

20. The method of claim 19, wherein the operational characteristic includes mainlobe performance.

21. The method of claim 19, wherein the operational characteristic includes sidelobe performance.

22. Thc method of claim 21, wherein the sidelobe performance includes sidelobe suppression over an associated cell of each reflector.

23. The method of claim 19, wherein the operational characteristic includes a size of the cell served by the beam.

24. The method of claim 19, wherein the operational characteristic includes a shape of the cell served by the beam.

25. The method of claim 19, wherein the plurality of reflectors are disposed on a platform and the operational characteristic includes platform to cell geometry.

26. The method of claim 19, wherein the operational characteristic includes an altitude of the single beam reflectors.

27. The method of claim 19, wherein the operational characteristic includes an operating frequency.

28. The method of claim 19, wherein the operational characteristic includes a beam field of view.

29. The method of claim 19, wherein a reflector associated with the at least one of the plurality of beams is shaped to provide the optimized operational characteristic.

30. The method of claim 19, wherein a feed associated with the at least one of the plurality of beams is optimized to provide the optimized operational characteristic.

31. The method of claim 19, wherein each reflector is pointed at a center of the beam produced by the reflector.

32. The method of claim 19, wherein each reflector is rotated to point at a center of the beam produced by the reflector.

33. The method of claim 19, wherein a shape of at least one of the cells of the on-station pattern is different than a shape of another one of the cells of the on-station pattern.

34. The method of claim 19, wherein the on-station pattern omits one or more cells.

35. The method of claim 19, wherein one or more cells of the on-station pattern overlap.

36. The multibeam antenna system of claim 1, wherein the single beam reflectors are disposed at a high altitude.

37. The multibeam antenna system of claim 8, wherein the altitude of the single beam reflectors is a high altitude.

38. The multibeam antenna system of claim 1, wherein the single beam reflectors are disposed above ground.

39. The method of claim 19, wherein the single beam reflectors are disposed at a high altitude.

40. The method of claim 26, wherein the altitude of the single beam reflectors is a high altitude.

41. The method of claim 19, wherein the single beam reflectors are disposed above ground.

42. A high altitude platform, comprising:

a multi-beam antenna system for generating multiple beams, including a plurality of single beam reflectors, each having its own feed, the plurality of single beam reflectors producing a plurality of beams, each beam serving a substantially separate cell of an on-station pattern; and wherein at least one of the plurality of beams are optimized for an operational characteristic.

43. The high altitude platform of claim 42, wherein the operational characteristic includes mainlobe performance.

44. The high altitude platform of claim 42, wherein the operational characteristic includes sidelobe performance.

45. The high altitude platform of claim 44, wherein the sidelobe performance includes sidelobe suppression over an associated cell of each reflector.

46. The high altitude platform of claim 42, wherein the operational characteristic includes a size of the cell served by the beam.

47. The high altitude platform of claim 42, wherein the operational characteristic includes a shape of the cell served by the beam.

48. The high altitude platform of claim 42, wherein the plurality of reflectors are disposed on a platform and the operational characteristic includes platform to cell geometry.

49. The high altitude platform of claim 42, wherein the operational characteristic includes an altitude of the single beam reflectors.

50. The high altitude platform of claim 42, wherein the operational characteristic includes an operating frequency.

51. The high altitude platform of claim 42, wherein the operational characteristic includes a beam field of view.

52. The high altitude platform of claim 42, wherein the operational characteristic includes uniform illumination of the cell.

53. Thc high altitude platform of claim 42, wherein a reflector associated with the at least one of the plurality of beams is shaped to provide the optimized operational characteristic.

54. The high altitude platform of claim 42, wherein feed associated with the at least one of the plurality of beams is optimized to provide the optimized operational characteristic.

55. The high altitude platform of claim 42, wherein each reflector is pointed at a center of the beam produced by the reflector.

56. The high altitude platform of claim 42, wherein each reflector is rotated to point at a center of the beam produced by the reflector.

57. The high altitude platform of claim 42, wherein a shape of at least one of the cells of the on-station pattern is different than a shape of another one of the cells of the on-station pattern.

58. The high altitude platform of claim 42, wherein the on-station pattern omits one or more cells.

59. The high altitude platform of claim 42, wherein one or more cells of the on-station pattern overlap.

* * * * *